US009117345B2

(12) United States Patent
Azuma et al.

(10) Patent No.: US 9,117,345 B2
(45) Date of Patent: Aug. 25, 2015

(54) GAME MACHINE, GAME SYSTEM, AND GAME CONTROL METHOD

(71) Applicants: Shogo Azuma, Minato-ku (JP); Mitsuru Kodama, Minato-ku (JP); Shinya Ito, Minato-ku (JP); Norifumi Kawai, Minato-ku (JP)

(72) Inventors: Shogo Azuma, Minato-ku (JP); Mitsuru Kodama, Minato-ku (JP); Shinya Ito, Minato-ku (JP); Norifumi Kawai, Minato-ku (JP)

(73) Assignee: KONAMI DIGITAL ENTERTAINMENT CO., LTD., Minato-Ku, Tokyo (JP)

( * ) Notice: Subject to any disclaimer, the term of this patent is extended or adjusted under 35 U.S.C. 154(b) by 70 days.

(21) Appl. No.: 13/862,767

(22) Filed: Apr. 15, 2013

(65) Prior Publication Data

US 2013/0281178 A1 Oct. 24, 2013

(30) Foreign Application Priority Data

Apr. 19, 2012 (JP) ..... 2012-096086

(51) Int. Cl.
*A63F 9/24* (2006.01)
*G07F 17/32* (2006.01)

(52) U.S. Cl.
CPC ..... *G07F 17/329* (2013.01); *G07F 17/3258* (2013.01); *G07F 17/3272* (2013.01); *G07F 17/3281* (2013.01)

(58) Field of Classification Search
None
See application file for complete search history.

(56) References Cited

U.S. PATENT DOCUMENTS

2006/0217188 A1* 9/2006 Walker et al. ..... 463/25
2007/0184889 A1* 8/2007 Walker et al. ..... 463/16
2008/0009334 A1* 1/2008 Walker et al. ..... 463/16
2008/0268946 A1* 10/2008 Roemer ..... 463/27
2010/0022295 A1* 1/2010 Okada ..... 463/20
2010/0056251 A1* 3/2010 Jaffe et al. ..... 463/20
2011/0039615 A1* 2/2011 Acres et al. ..... 463/20
2011/0230254 A1* 9/2011 Englman et al. ..... 463/25
2011/0312409 A1* 12/2011 Vancura ..... 463/25
2012/0309490 A1* 12/2012 Okada ..... 463/20
2013/0157733 A1* 6/2013 Thorne et al. ..... 463/1

FOREIGN PATENT DOCUMENTS

JP 2010-110525 A 5/2010

OTHER PUBLICATIONS

Japanese Office Action with English Translation—Issued: Apr. 30, 2014.
Patent Examination Report No. 1 (AU 2013205282); Date of Issue: Jan. 12, 2015.

* cited by examiner

*Primary Examiner* — Jason Yen
(74) *Attorney, Agent, or Firm* — Howard & Howard Attorneys PLLC

(57) ABSTRACT

In the game machine which includes a plurality of lottery machines having different lottery probabilities and executing a plurality of lotteries by a plurality of lottery machines selected as a predetermined combination among a plurality of lottery machines as a chance game provided in common to players, a plurality of station units is provided with a touch panel which receives an operation of the player. The game machine executes the lotteries by the plurality of lottery machines as the chance game in a predetermined order. The game machine changes at least one of the plurality of lottery machines into another lottery machine according to an operation input from the touch panel in case that a predetermined change condition is satisfied. The change of the combination of the plurality of lottery machines is applied to the chance game for other players playing the chance game.

10 Claims, 14 Drawing Sheets

GAME MACHINE, GAME SYSTEM, AND GAME CONTROL METHOD

CROSS REFERENCE TO RELATED APPLICATION

This application claims priority to Japanese Patent Application No. 2012-096086, filed Apr. 19, 2012, the disclosure of which is hereby incorporated by reference in its entirety.

TECHNICAL FIELD

The present invention relates to a game machine and the like which provides a lottery game capable of paying payout to a player based on an option selected from a plurality of options.

BACKGROUND ART

For example, as a medal game machine, game machines which provides a lottery game capable of paying payout to a player based on an option selected from a plurality of options is well-known (for example, see Patent Literature 1). In such a game machine, various lottery games are provided. A player can challenge the lottery game according to game progress. When the player wins the lottery game, the player can obtain predetermined payout in each lottery game when winning the lottery game.

Patent Literature 1: JP-A-2010-110525.

SUMMARY OF INVENTION

Technical Problem

In the above-described game machine, the lottery probability or payout of each lottery game is predetermined. The player plays the lottery game permitted to play according to game progress. In general, a high payout lottery game such as a jackpot lottery game is set such that the player cannot always challenge the jackpot lottery but can challenge the jackpot lottery after winning a plurality of lottery games. Accordingly, when the order or setting of the lottery game is fixed, the game is apt to be monotonous because the next lottery game cannot be progressed when the first lottery game is not won.

Therefore, the present invention aims to provide a game machine and the like, which are capable of flexibly changing the setting of a lottery game.

Solution to Problem

The game machine of the present invention is a game machine including a plurality of lottery mechanisms having different lottery probabilities and executing a lottery by a selected lottery mechanism selected among the plurality of lottery mechanisms as a lottery game provided in common to players, wherein the game machine comprising: a plurality of operation devices which receive an operation of the player; a lottery mechanism changing device which changes the selected lottery mechanism into another lottery mechanism according to an operation input from the operation device in case that a predetermined change condition is satisfied; and a lottery executing device which executes the lottery by the selected lottery mechanism as the lottery game, wherein the lottery executing device executes the lottery that the change of the selected lottery mechanism by the lottery mechanism changing device is applied to the lottery game for other players playing the lottery game.

The game machine of the present invention is a game machine including a plurality of lottery mechanisms having different lottery probabilities and executing a plurality of lotteries by a plurality of selected lottery mechanism selected as a predetermined combination among the plurality of lottery mechanisms as a lottery game provided in common to players, wherein the game machine comprising: a plurality of operation devices which receive an operation of the player; a lottery mechanism changing device which changes at least one of the plurality of selected lottery mechanisms into another lottery mechanism according to an operation input from the operation device in case that a predetermined change condition is satisfied; and a lottery executing device which executes the lotteries by the plurality of selected lottery mechanisms as the lottery game in a predetermined order, wherein the lottery executing device executes the lottery that the change of the combination of the plurality of selected lottery mechanisms by the lottery mechanism changing device is applied to the lottery game for other players playing the lottery game.

According to the game machine of the present invention, in the lottery game performing the lottery by the selected lottery mechanism, the player can change the selected lottery mechanism into another lottery mechanism in case that a predetermined change condition is satisfied. The lottery mechanism changed is also applied to other players playing in the game machine. Accordingly, the setting of the lottery game can be flexibly changed and thus the player can play the game by a preferred lottery machine. Furthermore, since the change is applied to other players, a sense of unity is generated in the entire game machines and competition for lottery mechanism change is generated among the players. Therefore, the suspense of the game play is increased and the interest of the game is increased.

As one aspect of the game machine of the present invention, as the lottery probability of each of the plurality of lottery mechanisms decreases, the payout thereof increases. According to this, since the lottery probabilities and payout of the respective lottery mechanisms are different from each other, the lottery mechanism can be selected according to the preference of the player. The lottery mechanism can be provided according to the desire of the player attempting high payout in spite of a low lottery probability or the desire of the player preferring to win at a high probability in spite of low payout.

As one aspect of the game machine of the present invention, the losing in the lottery of the lottery game is set as the change condition and the lottery mechanism changing device allows the lost player to change the selected lottery mechanism. According to this, the player having lost in the lottery game can change the selected lottery mechanism. Since the player can change the selected lottery mechanism into a preferred lottery mechanism, the expectation of winning in the next lottery game is increased and the game continuation is motivated.

As one aspect of the game machine of the present invention, the execution of the lottery of the lottery game is set as the change condition and the lottery mechanism changing device allows the player playing the lottery of the lottery game to change the selected lottery mechanism before the execution of the lottery. According to this, the player to perform the lottery game can perform the lottery after changing the selected lottery mechanism into a preferred lottery mechanism. Since the player can perform the lottery by the lottery mechanism selected by the player himself, the expectation of winning is increased, and the game continuation is motivated.

As one aspect of the game machine of the present invention, comprising: an option lottery device which selects any one of a plurality of options, wherein at least one of the plurality of options is a change option which allows the player to change the selected lottery mechanism, the winning selection of the change option in the lottery by the option lottery device is set as the change condition and the lottery mechanism changing device allows the winning player to change the selected lottery mechanism. According to this, when the change option is selected in the game other than the lottery game in the game machine, the player can change the selected lottery mechanism of the lottery game. The selected lottery mechanism of the lottery game can be changed even when the player does not play the lottery game. Therefore, the player can participate in the game progress when another player selects the lottery game. Accordingly, a sense of unity is formed among the players playing in the game machine and thus the interest of the game can be increased.

As one aspect of the game machine of the present invention, comprising: a vote executing device which determines a lottery mechanism to be changed among the plurality of lottery mechanism based on the vote by the players in case that a predetermined vote condition is satisfied, wherein the satisfaction of the vote condition is set as the change condition and the lottery mechanism changing device changes the selected lottery mechanism into a lottery mechanism determined based on the vote by the vote executing device. According to this, in case that the vote condition is satisfied, a vote for determining a lottery mechanism to be changed among the players playing in the game machine is executed. For example, when the lottery mechanism is changed into a lottery mechanism having the largest number of votes, the lottery mechanism is changed into a lottery mechanism determined according to the number of votes of the player. Since all of the players playing in the game machine can participate, a sense of unity is formed among the players and thus the interest of the game can be increased.

In the aspect that the vote executing device is provided, the case where the accumulated number of times of losing of all the players in the lottery game reaches a predetermined number of times may be set as the vote condition. According to this, since a vote is executed in the state where there is no winner of the lottery game and the player playing in the game machine changes the lottery mechanism into the most preferred lottery mechanism, the expectation of winning in the lottery game is increased.

The game system of the present invention is a game system comprising: a plurality of game machines which include a plurality of lottery mechanisms having different lottery probabilities and execute a lottery by a selected lottery mechanism selected among the plurality of lottery mechanisms as a lottery game provided in common to players; and a server device which connects to the plurality of game machines through a network, wherein the game system comprising: a plurality of operation devices which receive an operation of the player; a lottery mechanism changing device which changes the selected lottery mechanism of the plurality of game machines into another lottery mechanism according to an operation input from the operation device in case that a predetermined change condition is satisfied; and a lottery executing device which executes the lottery by the selected lottery mechanism as the lottery game, wherein the lottery executing device executes the lottery that the change of the selected lottery mechanism by the lottery mechanism changing device is applied to the lottery game for other players playing the lottery game in each game machine.

According to the game system of the present invention, a plurality of game machines and a server are connected through a network and all of the players playing in each game machine use the same selected lottery mechanism in the lottery game. in case that the selected lottery mechanism is changed, the selected lottery mechanism of all players is changed. Therefore, the setting of the lottery game can be flexibly changed and thus the player can play the lottery game by a preferred lottery machine. Furthermore, since the change is applied to other players, a sense of unity is generated in the entire game machines and competition for lottery mechanism change is generated among the players. Accordingly, the suspense of the game play is increased and the interest of the game is increased.

The game control method of the present invention is a game control method executed in a game machine which includes a plurality of operation devices which receive an operation of the player and a plurality of lottery mechanisms having different lottery probabilities and executing a lottery by a selected lottery mechanism selected among the plurality of lottery mechanisms as a lottery game provided in common to players, wherein the game control method comprising: a lottery mechanism changing step which changes the selected lottery mechanism into another lottery mechanism according to an operation input from the operation device in case that a predetermined change condition is satisfied; and a lottery executing step which executes the lottery by the selected lottery mechanism as the lottery game, wherein in the lottery executing step, the lottery that the change of the selected lottery mechanism by the lottery mechanism changing step is applied to the lottery game for other players playing the lottery game is executed. By executing the game control method of the present invention, the game machine of the present invention is implemented.

Advantageous Effects of Invention

As described above, according to the present invention, in the lottery game performing the lottery by the selected lottery mechanism, the player can change the selected lottery mechanism into another lottery mechanism in case that a predetermined change condition is satisfied. The lottery mechanism changed is also applied to other players playing in the game machine. Accordingly, the setting of the lottery game can be flexibly changed and thus the player can play the game by a preferred lottery machine. Furthermore, since the change is applied to other players, a sense of unity is generated in the entire game machines and competition for lottery mechanism change is generated among the players. Therefore, the suspense of the game play is increased and the interest of the game is increased.

DESCRIPTION OF EMBODIMENTS

Figure 1:
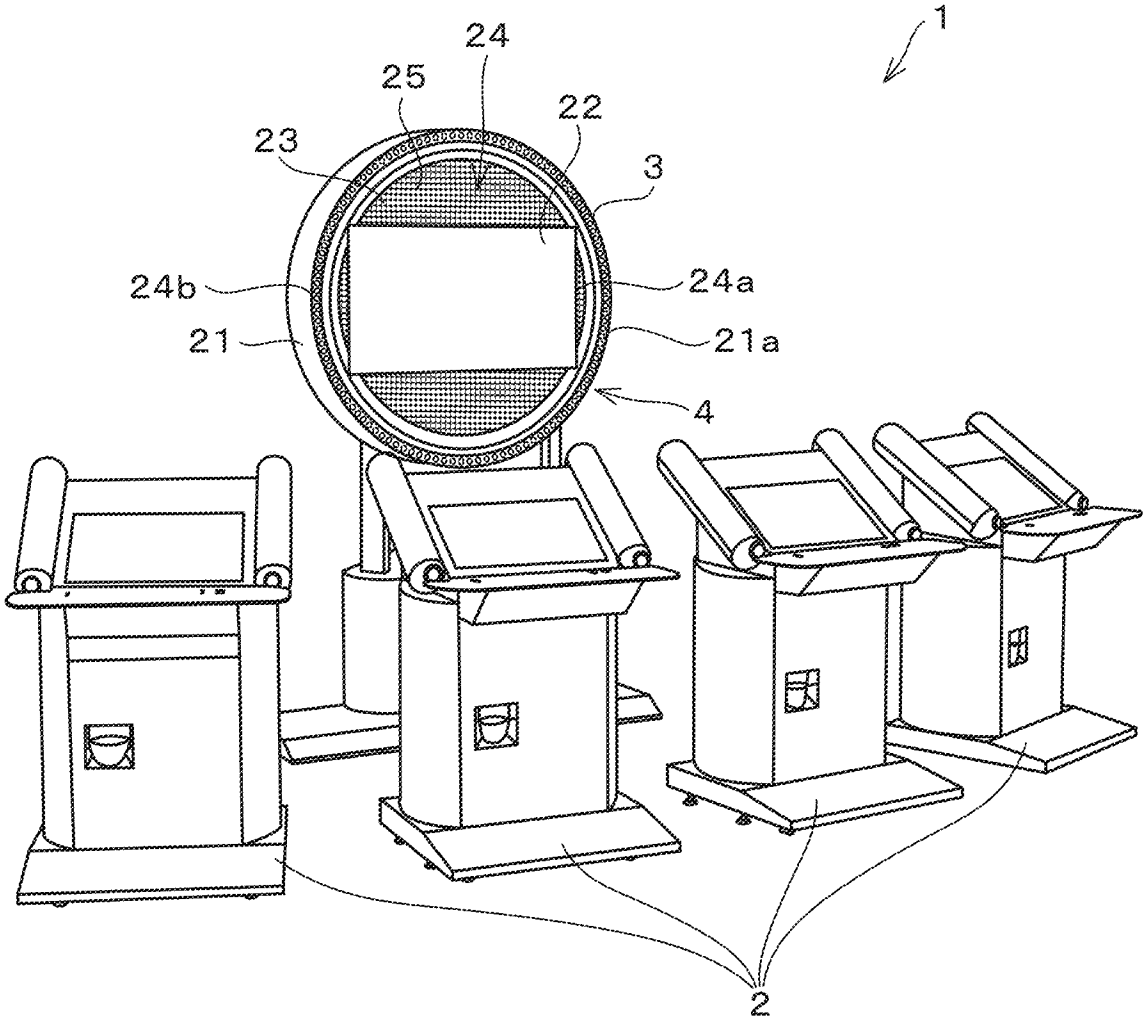
FIG. 1 is an overall view of a game machine according to one aspect of the present invention.
Figure 2:
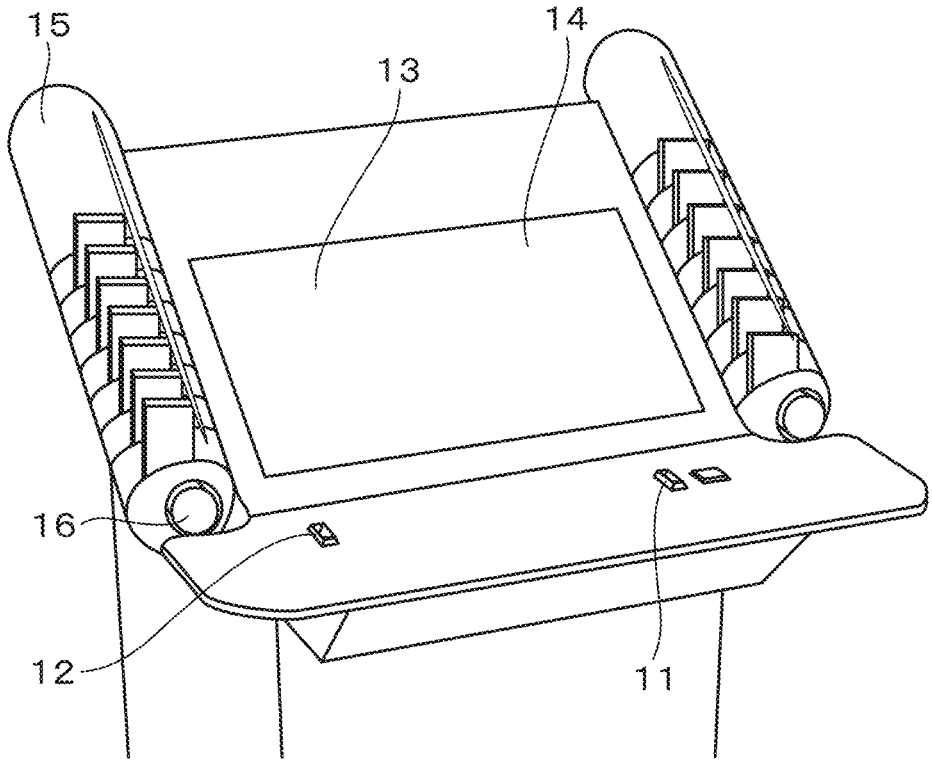
FIG. 2 is an enlarged view of the station unit.

FIG. 1 is an overall view of a game machine according to one aspect of the present invention. The game machine 1 includes a plurality of station units 2 and a center unit 3. The game machine 1 is a medal game machine using a medal as a game medium, and allows a predetermined range of game play in exchange for medals input by a player. The player plays the game by each station unit 2. FIG. 2 is an enlarged view of the station unit 2. Each station unit 2 includes a medal insertion slot 11, a coin insertion slot 12, a monitor 13 displaying a game screen, a transparent touch panel 14 superimposed on the surface of the monitor 13 as an operation device, a pair of bonus step display units 15 which displays an indication of the start of a bonus game and a pair of chance game buttons 16 which starts a chance game.

In each station unit 2, a dual play is available, and the bonus step display unit 15 and the chance game button 16 arranged on each of the left and right sides are allocated to each player. The bonus step display unit 15 is provided with a plurality of lights, and the lights are turned on/off according to game progress. When all of the lights are turned on, the bonus game is executed. In case that a predetermined game condition is satisfied, the chance game button 16 can be pressed. When the chance game button 16 is pressed, the chance game is executed. The medal insertion slot 11 and the coin insertion slot 12 are provided in common to the respective players. For example, when a 100-yen coin is inserted into the coin insertion slot 12, medals M exchangeable for 100 yen is retained and the medal M is consumed according to the play. As an example, a liquid crystal display is applied to the monitor 13, and the game is progressed when the touch panel 14 superimposed on the monitor 13 is operated by the player.

The center unit 3 is provided with a common display device 4. The common display device 4 is provided with a housing 21 and an LED display 24 including a liquid crystal display 22 as a first display device supported by the housing 21 and a plurality of LED elements 23 as a plurality of second display devices. A variety of well-known rectangular liquid crystal display devices are applied to the liquid crystal display 22. The LED display 24 is provided with a light diffusing panel 25 covering the LED elements 23. The light diffusing panel 25 includes a resin plate having a surface asperity, and diffuses light emitted by the LED elements 23. A well-known light diffusing plate may be used in the light diffusing panel 25. In addition, a plurality of decorative lights 21*a* is arranged around the LED display 24 to surround the LED display 24. In addition, a decoration and an illumination may be provided around the liquid crystal display 22 and the LED display 24. The liquid crystal display 22 and the LED display 24 may be collectively referred to as an entire display. A rotary driving mechanism (not illustrated) is provided in the common display device 4. The rotary driving mechanism drives the entire display to rotate.

Figure 3:
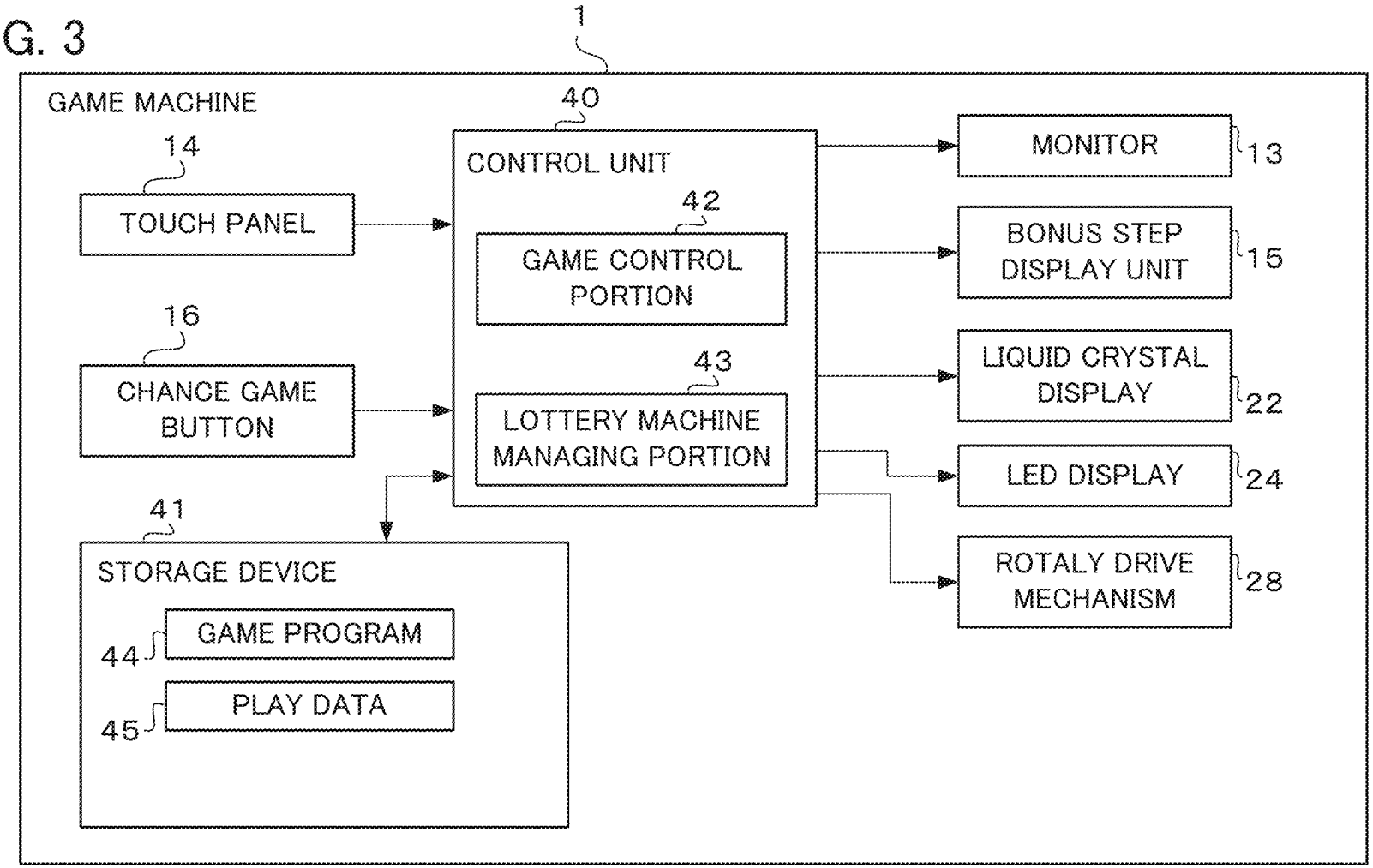
FIG. 3 is a functional block diagram showing a configuration of a control system of the game machine.

FIG. 3 is a functional block diagram showing a configuration of a control system of the game machine 1. The game machine 1 includes a control unit 40 and a storage device 41. The control unit 40 is a computer unit that includes a microprocessor, a ROM recording a program such as an operating system to be executed in the microprocessor and an internal storage device (not illustrated) such as a RAM providing a work area for the microprocessor. Input devices such as the touch panel 14 and the chance game button 16, and output devices such as the monitor 13, the bonus step display unit 15, the liquid crystal display 22, the LED display 24, and the rotary drive mechanism 28 are connected to the control unit 20.

A game control portion 42 and a lottery machine managing portion 43 are provided in the control unit 40. The game control portion 42 and the lottery machine managing portion 43 are logical devices which are achieved by a combination of predetermined software and computer hardware of the control unit 40. The game control portion 42 executes a variety of processing that is related to the play of an arcade game such as management of the start, progress and end of the game, and the collection of a play fee in the game machine 1. The lottery machine managing portion 43 is configured to select or manage a lottery machine used in the chance game. In addition, although not illustrated, the control unit 40 of the game machine 1 executes a variety of processing such as display control processing of the monitor 13 or the common display device 4 and management processing of medals or coins collected from the player.

The storage device 41 stores a game program 44 and play data 45. The game program 44 is executed by the control unit 40 to provide the game playable in the game machine 1. The play data 45 includes data of the game played by each player. The game machine 1 may be configured so as to authenticate the player by a card storing a player ID, and a part of the play data associated with the player ID may be obtained from a server.

Figure 4:
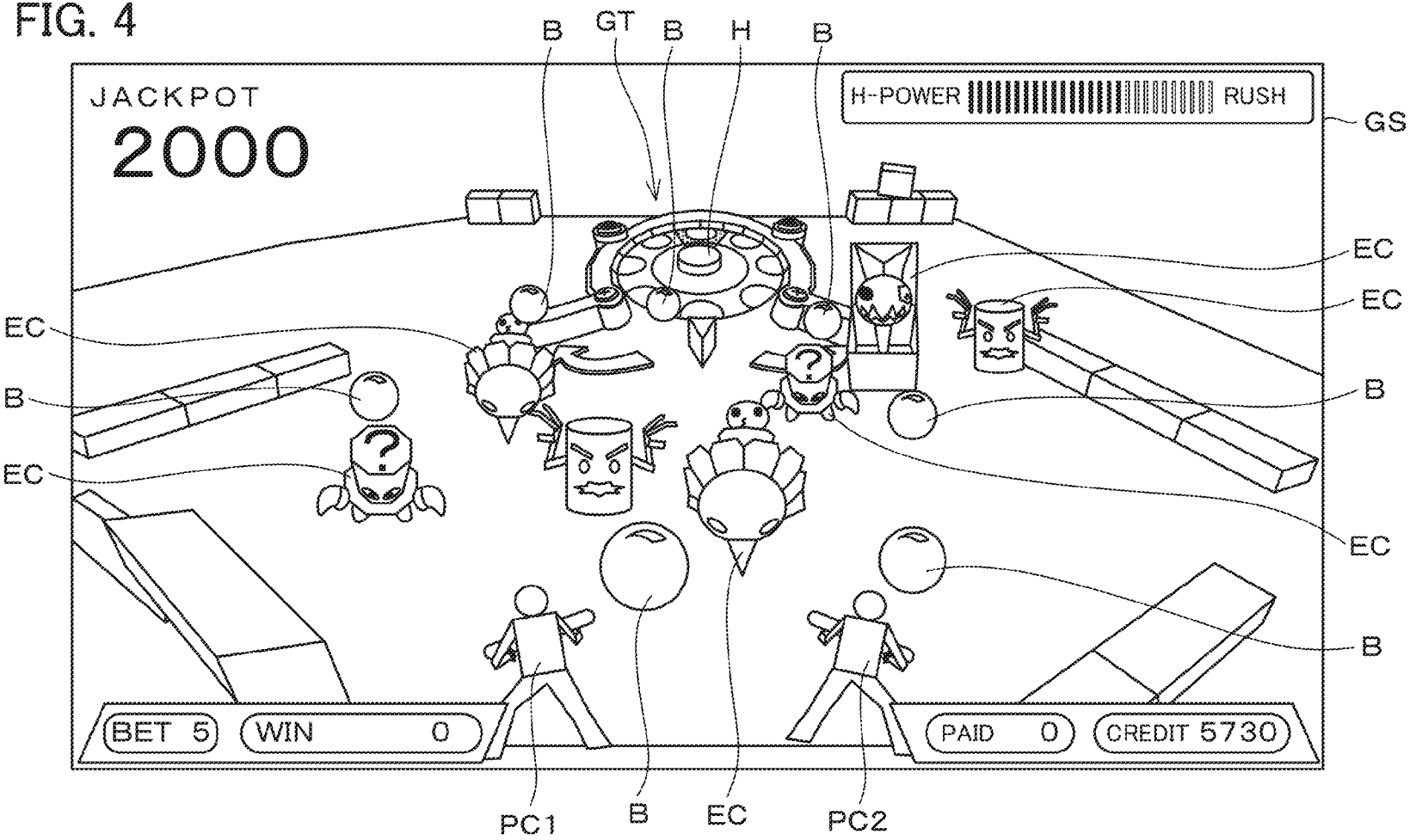
FIG. 4 is a view illustrating an example of a game screen displayed on the monitor of each station unit.

The game executed in the game 1 will be described with reference to FIG. 4. FIG. 4 is a view illustrating an example of a game screen GS displayed on the monitor 13 of each station unit 2. On the game screen GS, player characters PC1 and PC2 operated by the respective players (which will be represented by a referential mark "PC" if discrimination therebetween is not necessary), an enemy character EC and a ball B thrown by the player character PC are displayed. The player can make the player character PC throw the ball B according to the number of medals inserted into the game machine 1. When the ball B hits the enemy character ES, the enemy character EC is defeated. When the enemy character EC is defeated, a gate GT located inside at the center of the game screen GS is opened. When the ball B enters a hit hole H in the gate GT, one of the lights provided in the bonus step display unit 15 is turned on. When all of the lights of the bonus step display unit 15 are turned on, the bonus game is started on the monitor 13.

Figure 5:
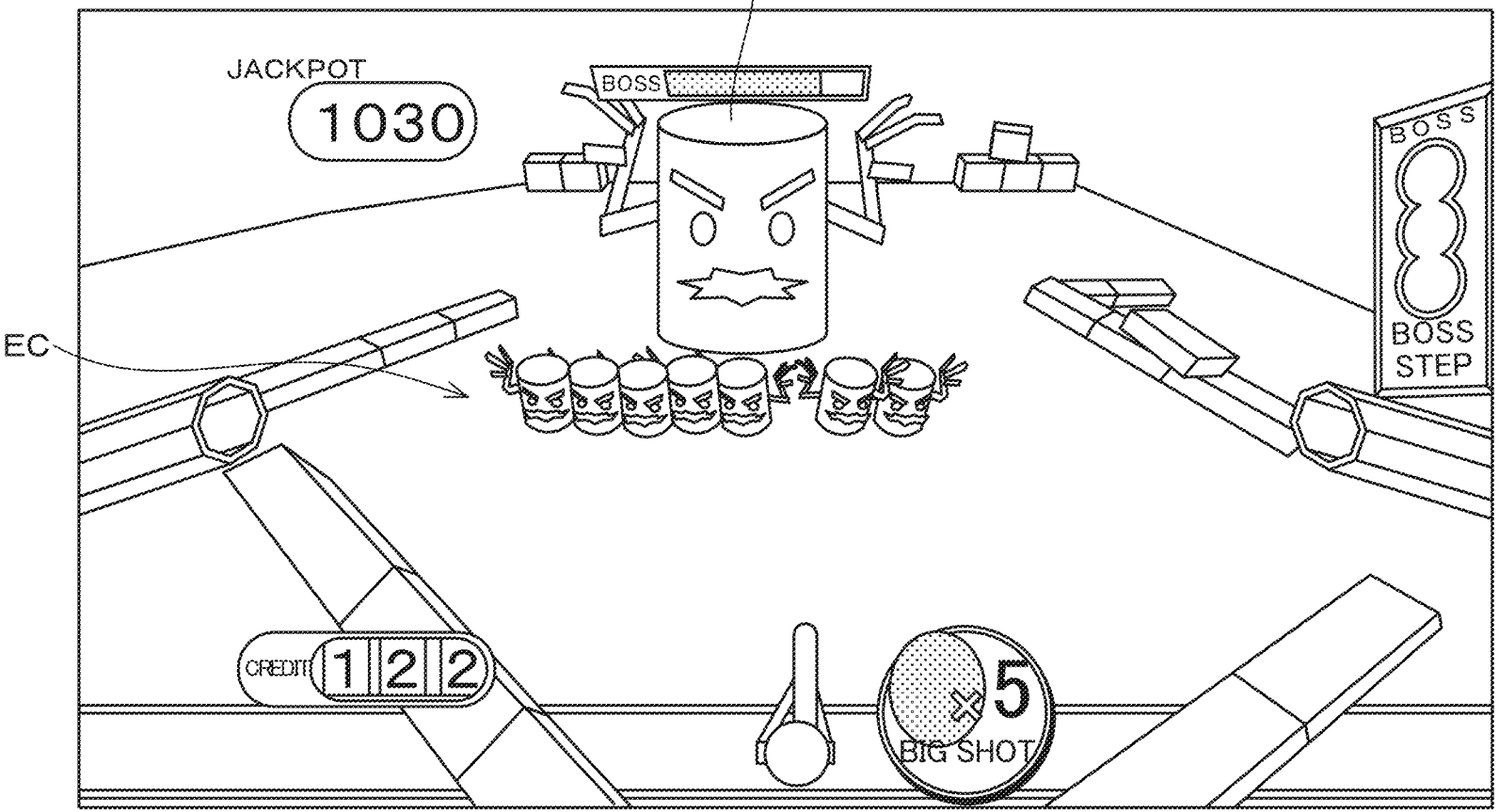
FIG. 5 is a view illustrating an example of a bonus game in the game screen.
Figure 6:
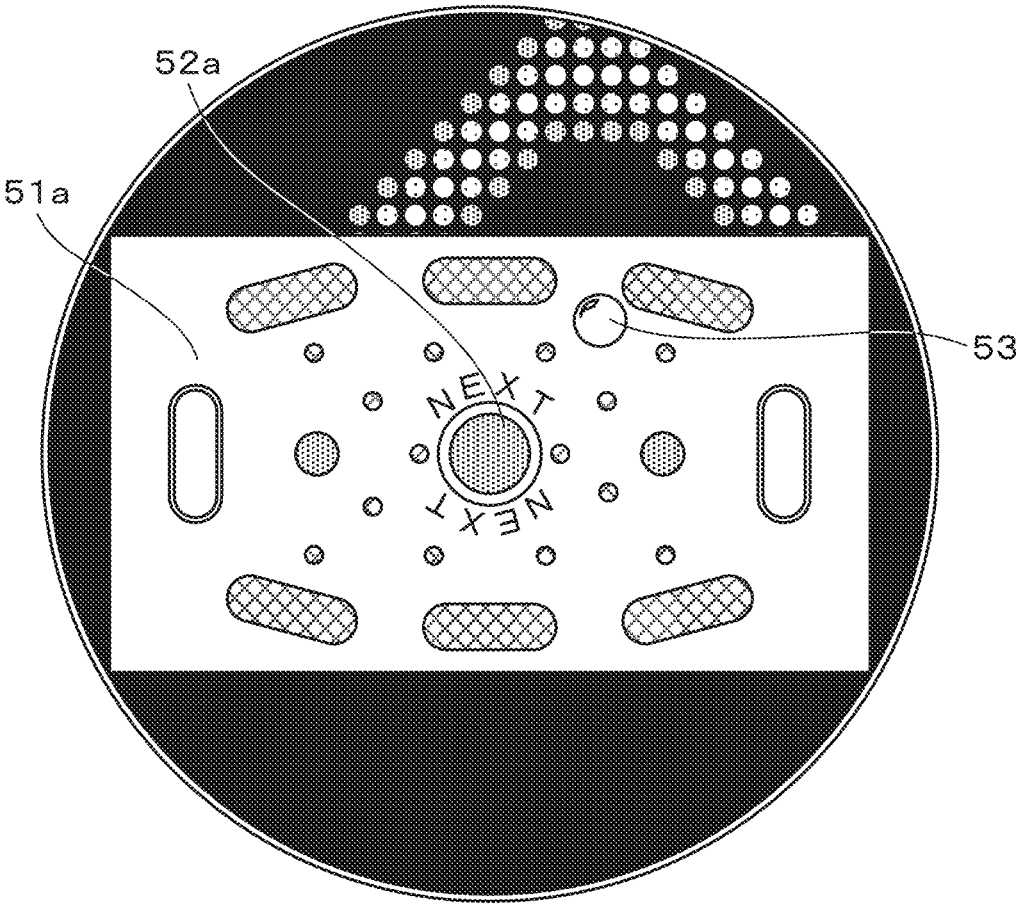
FIG. 6 is a view illustrating an example of a lottery machine displayed in the common display device.
Figure 7:
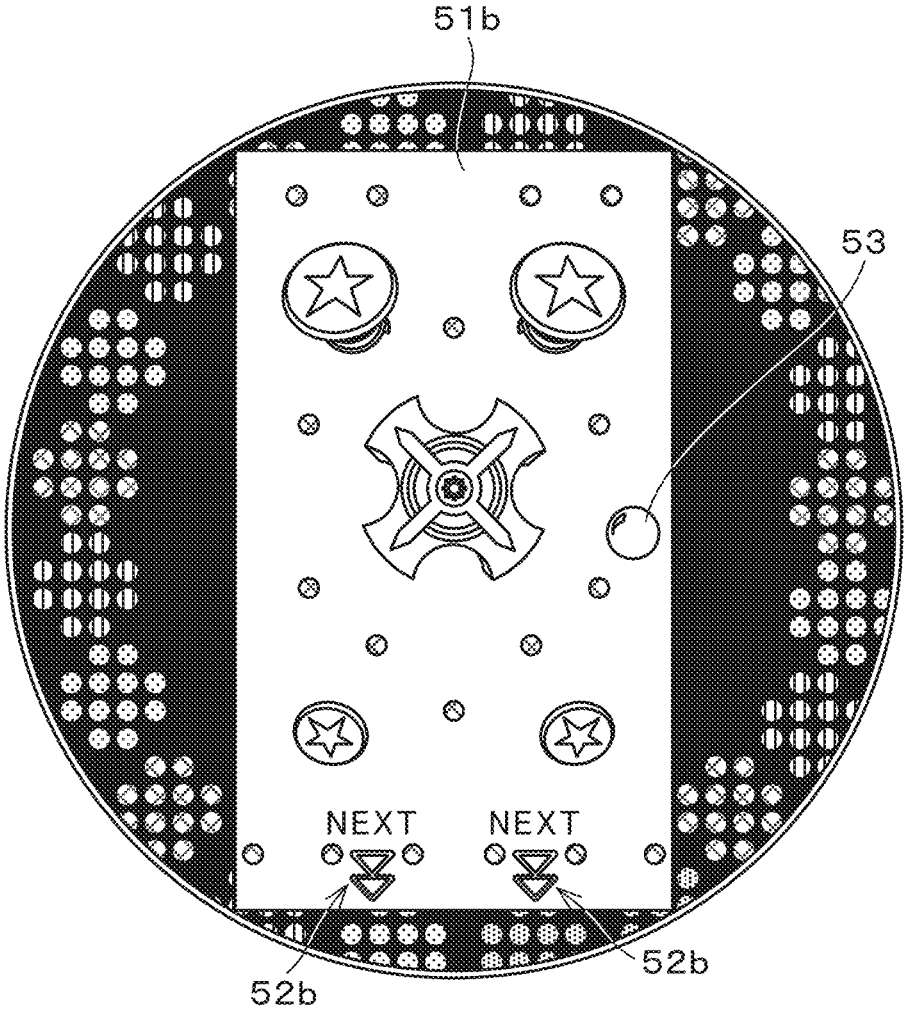
FIG. 7 is a view illustrating another example of a lottery machine displayed in the common display device.
Figure 8:
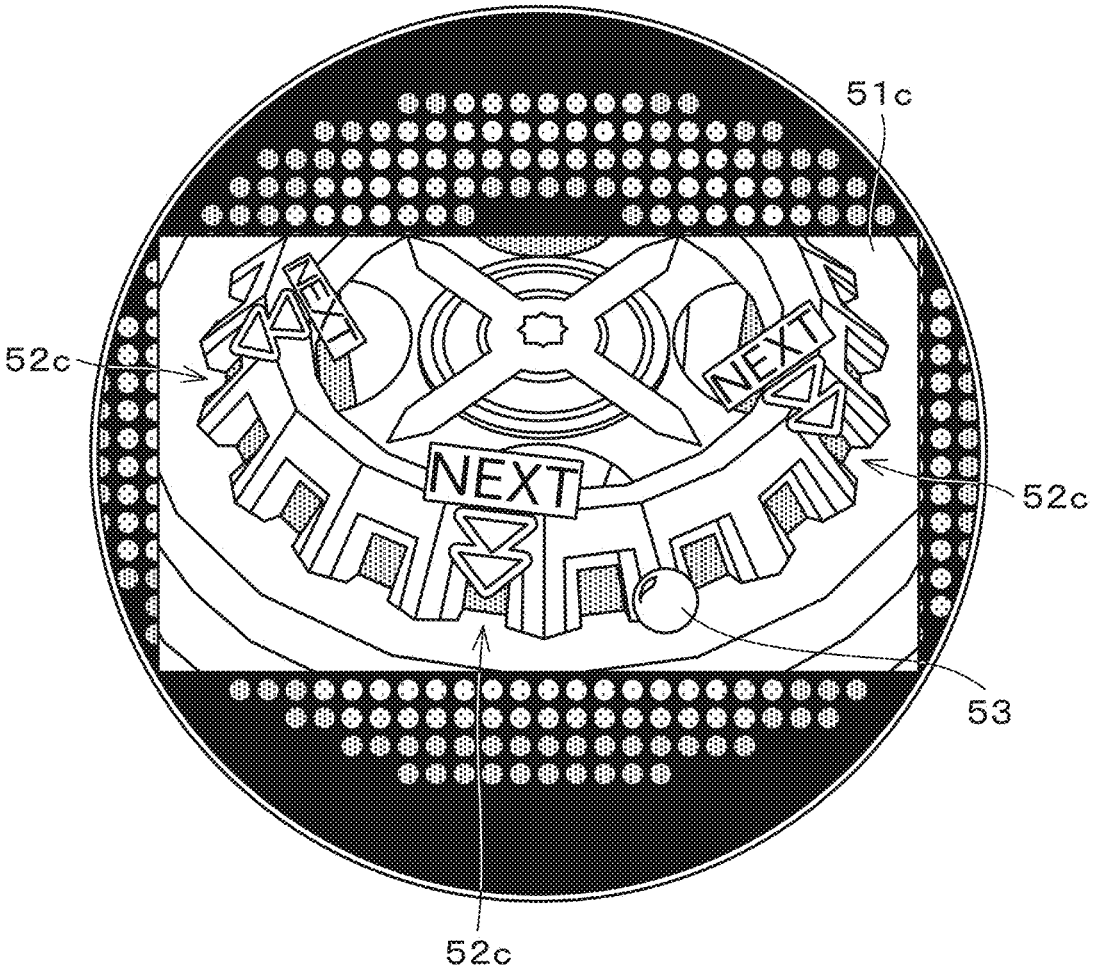
FIG. 8 is a view illustrating another example of a lottery machine displayed in the common display device.
Figure 9:
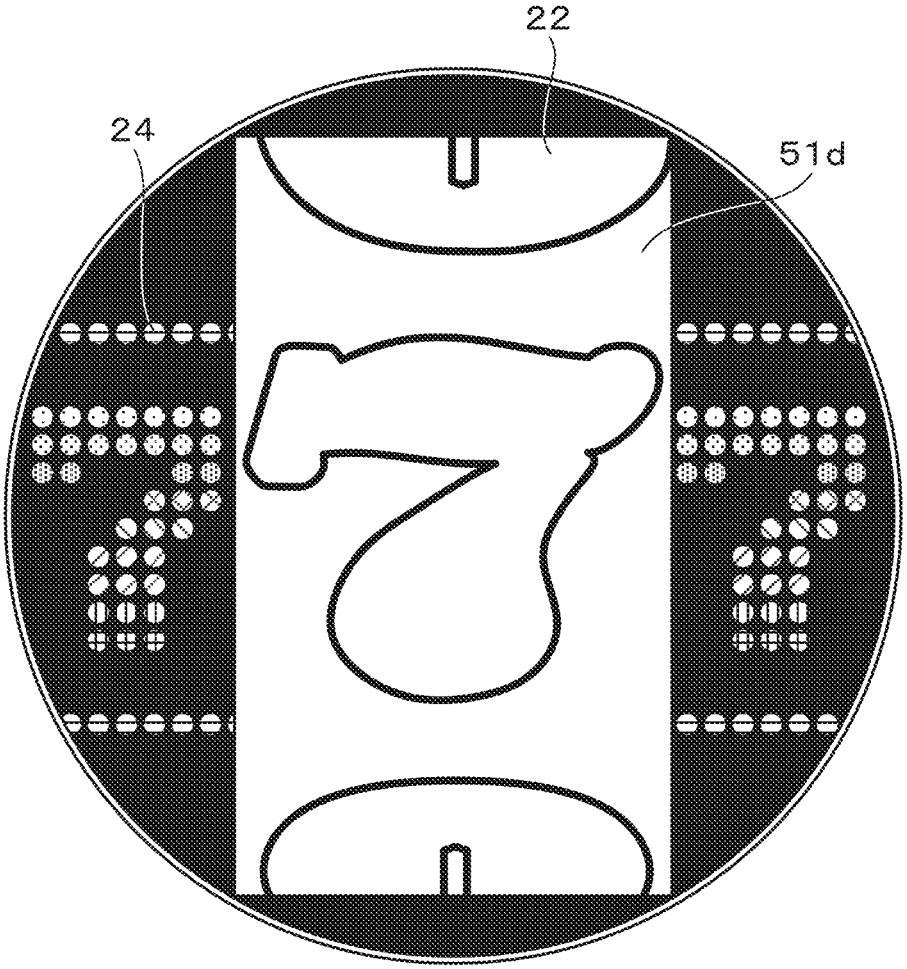
FIG. 9 is a view illustrating another example of a lottery machine displayed in the common display device.

FIG. 5 is a view illustrating another example of the game screen GS. In the game screen GS of FIG. 5, an example of the bonus game is illustrated. In the bonus game, the player is given a predetermined number of large balls (for example, five balls), and throws the large balls at a boss character ECB to defeat the boss character ECB. When the boss character ECB is defeated, the player is allowed to press the chance game button 16. When the chance game button 16 is pressed by the player, the chance game is started. The chance game is displayed on the common display device 4. In the chance game, a plurality of lottery machines is prepared as a plurality of lottery mechanisms, and lotteries with different lottery probabilities are performed in the respective lottery machines. When winning a lottery performed by three lottery machines, the player can obtain a jackpot.

FIGS. 6 to 9 are views illustrating examples of the lottery machine displayed in the common display device 4. A lottery machine 51*a* of FIG. 6 includes a pinball-type lottery mechanism. When a lottery ball 53 enters a predetermined lottery hole 52*a*, the lottery is won. The lottery machine 51*b* of FIG. 7 includes a pachinko-type lottery mechanism. When the lottery ball 53 enters a predetermined lottery hole 52*b*, the lottery is won. The lottery machine 51*c* of FIG. 8 includes a clune-type lottery mechanism. When the lottery ball 53 enters a predetermined lottery hole 52*c*, the lottery is won. The lottery machine 51*d* of FIG. 9 includes a slot-type lottery mechanism. When predetermined numbers are collected, the lottery is won. In the chance game as a lottery game, for example, a lottery using the lottery machine 51*a* is executed as the first lottery. When the lottery is won, a lottery using the lottery machine 51*b* is executed as the second lottery. When the lottery is won, a lottery using the lottery machine 51*c* is executed as the third lottery. When winning the third lottery, the player can obtain the jackpot. On the other hand, when the lottery is not won, the chance game is ended, a medal payment is performed according to the lottery result and the game returns to a normal game. Each of the lottery machines used in the three lotteries of the chance game is predetermined, and can be changed by satisfying a predetermined change condition. The change condition will be described below.

As for the winning probability of three lottery machines preformed in the chance game, as initial settings, the winning probability of the first lottery machine 51*a* is set to ½, the winning probability of the next lottery machine 51*b* is set to ⅕, and the winning probability of the last lottery machine 51*c* is set to 1/10, so that an expectation value is set to 100 pieces when 100 pieces of medals are betted. When winning in the lottery machines 51, the player can receive the payment of 200 pieces of medals in the first lottery machine 51*a* by betting 100 pieces of medals, can receive the payment of 1000 pieces of medals in the second lottery machine 51*b* by betting 200 pieces of medals obtained in the first lottery and can receive the payment of 10000 pieces of medals in the third lottery machine 51*c* by betting 1000 pieces of medals obtained in the second lottery. In this manner, winning probabilities in the respective lottery machines 51*a* to 51*c* are different from each other, and payout amounts are different according to the winning probabilities. As the winning probability decreases, the payout increases. In the present aspect, an expectation value of 100 pieces is set with respect to a bet of 100 pieces of medals in one lottery by the lottery machine. In addition, lottery machines according to various mini games, such as a bingo-type lottery machine and a card-type (such as poker) lottery machine, are provided, and different lottery probabilities are set thereto.

Figure 10:
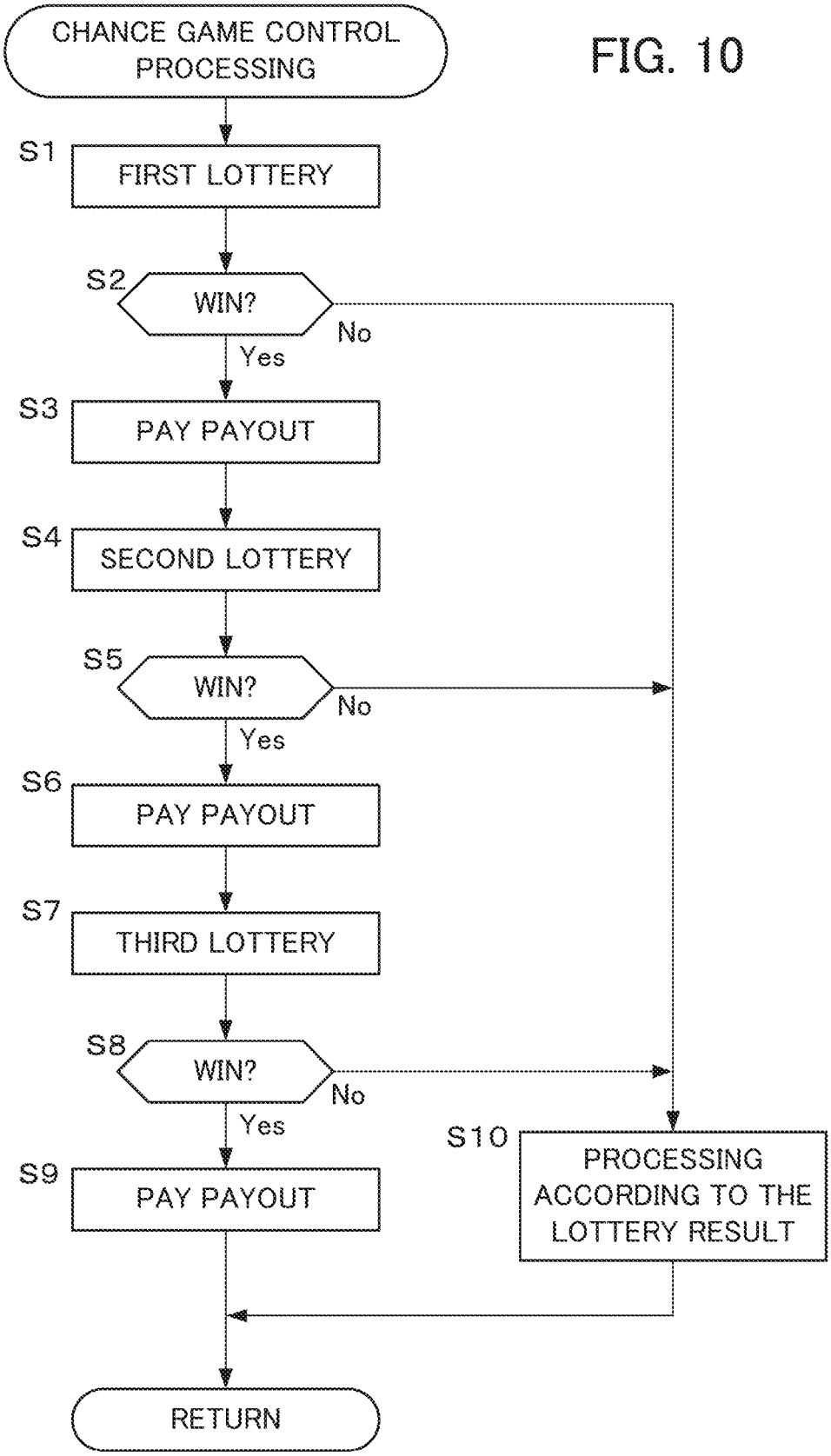
FIG. 10 is a flow chart illustrating the chance game control processing routine executed by a control unit.

FIG. 10 is a flow chart illustrating the chance game control processing routine executed by the control unit 40. The chance game control processing routine is processing for controlling the game progress of the chance game executed on the condition that the boss character ECB is defeated in the bonus game and the chance game button 16 is pressed. The control unit 40 executes the first lottery using the lottery machine 51*a* (step S1). A lottery is executed with the lottery probability set in the lottery machine 51*a*. Random numbers are used in the lottery. The control unit 40 determines whether the first lottery is won (step S2). When the first lottery is won, the control unit 40 makes game machine 1 pay payout (step S3), and executes the second lottery using the lottery machine 51*b* (step S4). In the second lottery, a play is performed with betting the first lottery payout. The control unit 40 determines whether the second lottery is won (step S5). When the second lottery is won, the control unit 40 pays payout (step S6). The control unit 40 executes the third lottery by betting the payout paid in the second lottery (step S7). The control unit 40 determines whether the third lottery is won (step S8). When the third lottery is won, the control unit 40 pays the jackpot together with predetermined effects (step S9) and quits the processing. On the other hand, if each lottery is lost, the control unit 40 executes processing according to the lottery result (step S10) and quits the processing. According to the lottery result, a small amount of payout or an item or the like available in the game is given to the player.

In the above-described processing, in the chance game, up to three lotteries are executed by the lottery machines 51*a* to 51*c* (steps S1, S4 and S7), and the player obtains the jackpot when the third lottery is won (step S9). The processing of steps S1, S4 and S7 executed by the game control portion 42 of the control unit 40 serves as a lottery executing device.

Figure 11:
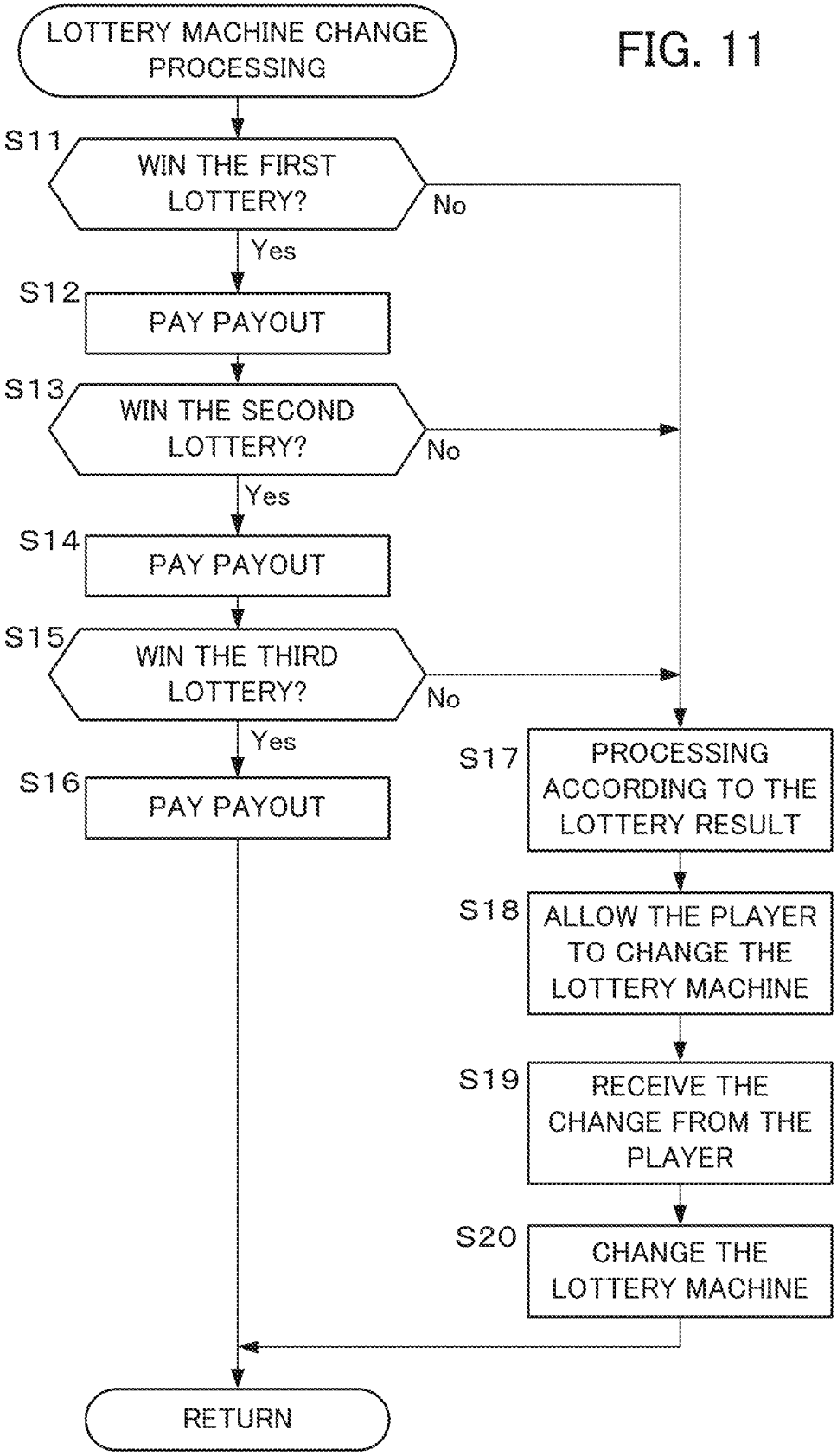
FIG. 11 is a flow chart illustrating a lottery machine change processing routine executed by the control unit.

FIG. 11 is a flow chart illustrating a lottery machine change processing routine executed by the control unit 40. The lottery machine change processing routine is processing for changing the lottery machine used in the chance game. As a change condition, the losing in a lottery of the chance game is set. First, the control unit 40 determines whether the player has won the first lottery by the lottery machine 51*a* in the chance game (step S11). When the player has won the first lottery, the control unit 40 makes the game machine 1 pay payout to the player (step S12). The control unit 40 executes the second lottery by the lottery machine 51*b* by betting the payout given to the player, and determines whether the player has won the second lottery (step S13). When the player has won the second lottery, the control unit 40 makes the game machine 1 pay payout to the player (step S14). The control unit 40 executes the third lottery by the lottery machine 51*c* by betting the payout given to the player, and determines whether the player has won the third lottery (step S15). When the player has won the third lottery, the player obtains the jackpot (step S16).

On the other hand, if any one of the lotteries in steps S11, S13 and S15 is lost, the control unit 40 executes processing according to the lottery result (step S17). According to the lottery result, a small amount of payout or an item or the like available in the game is given to the player. The control unit 40 allows the player to change the lottery machine in which the player has lost the lottery (step S18). In the case that the player has lost the first lottery the player can change the lottery machine 51*a* used in the first lottery. The control unit 40 receives the change from the player (step S19). When the player inputs an instruction for change to the lottery machine 51*d* into the touch panel 14, the control unit 40 changes the lottery machine used in the first lottery from the lottery machine 51*a* to the lottery machine 51*d* (step S20). The lottery machine 51*d* is also applied to other players playing in the game machine 1. Unless the lottery machine is changed again, the player playing the next chance game performs a lottery by the lottery machine 51*d* in the first lottery. The lottery machine is changed and the preference of the player is reflected. In this case, for example, only the lottery machine providing low payout is set, or the lottery machine providing high payout is set. Even a player having failed to participate in the chance game can change the setting of the chance game. Therefore, the player can enjoy viewing the winning or losing of other players in the lottery machine set by the player himself.

According to the above-described processing, when the player has lost the chance game (steps S11, S13 and S15), the player can change the lottery machine (step S18), in which the chance game has been lost, after processing according to the lottery result is performed (step S17). The player selects a desired lottery machine (step S19), and the lottery machine is changed (step S20). Herein, the lottery machine changed is applied as the setting of the entire game machine 1, and when another player plays the chance game, the chance game is played by the lottery game changed. The chance game is a game that is reflected by the preference of the player playing the game machine 1. This also means that the player intends to play by the lottery machine set by the player himself. Also, on the other hand, the lottery machine may be intentionally set to obstruct the chance game of other players. Accordingly, the game property of the game machine 1 can be diversified, and the interest of the game can be increased. In the above-described processing, the processing of steps S11, S13 and S15 executed by the lottery machine managing portion 43 of the control unit 40 serves as a lottery executing device and the processing of steps S18 to S20 serves as a lottery mechanism changing device. Three lottery machines selected in the chance game correspond to a selected lottery mechanism.

Figure 12:
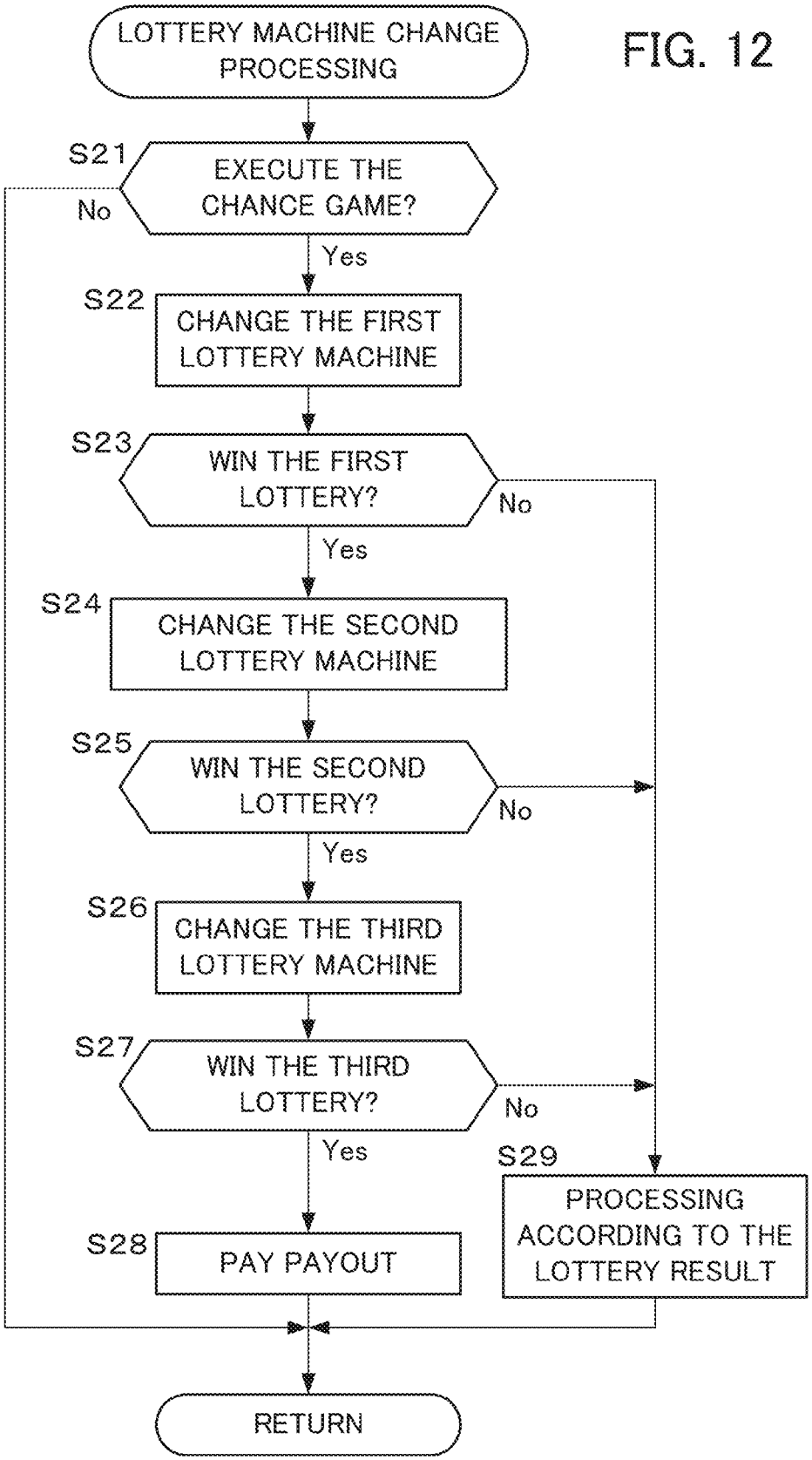
FIG. 12 is a flow chart illustrating a lottery machine change processing routine executed by the control unit of the game machine according to a first modification of the present invention.

The present invention is not limited to the above-described aspect, and can be carried out in various kinds of aspects. For example, the losing in the lottery by the chance game is set as the change condition in the present aspect, but the present invention is not limited thereto. For example, the execution of the lottery in the chance game may be set as the change condition. A game machine according to a first modification of the present invention will be described below. The main difference from the above-described aspect is the lottery machine change processing. Therefore, the lottery machine change processing will be mainly described, and a description of the other features equal to those of the above-described aspect will be omitted. FIG. 12 is a flow chart illustrating a lottery machine change processing routine executed by the control unit 40 of the game machine 1 according to the first modification of the present invention. In the lottery change processing according to the first modification, the control unit 40 determines whether the chance game has been executed (step S21). The chance game is generated by defeating the boss character ECB in a bonus game and pressing the chance game button 16. The determination can be made according to whether the chance game button 16 is pressed.

When the chance game is executed, the control unit 40 changes a lottery machine by making the player select any one of a plurality of lottery machines before the first lottery (step S22). The player can select a preferred lottery machine. The control unit 40 executes the first lottery by the lottery machine selected by the player and determines whether the first lottery is won (step S23). When the player has won the first lottery, the control unit 40 makes the game machine 1 pay payout to the player. The control unit 40 changes a lottery machine by making the player select any one of the plurality of lottery machines before the second lottery (step S24). In the second selection, the lottery machine selected in the first selection may be excluded, or may be selected again. The control unit 40 executes the second lottery by the lottery machine selected by the player, and determines whether the second lottery is won (step S25). When the player has won the second lottery, the control unit 40 makes the game machine 1 pay payout to the player. The control unit 40 changes a lottery machine by making the player select any one of the plurality of lottery machines before the third lottery (step S26). The control unit 40 determines whether the third lottery is won (step S27). When the third lottery is won, the control unit 40 makes the game machine 1 pay payout to the player (step S28) and quits the processing. On the other hand, if each lottery in steps S23, S25 and S27 is lost, the control unit 40 executes processing according to the lottery result (step S29) and quits the processing.

In the above-described processing, the player can select the lottery machine to be used before the lottery in each lottery machine (steps S22 to S27). Since the player can select a lottery machine before the lottery to be played, the player can enjoy selecting a lottery machine. Incidentally, the processing of steps S22, S24 and S26 executed by the lottery machine managing portion 43 of the control unit 40 serves as a lottery mechanism changing device, and the processing of steps S23, S25 and S27 serves as a lottery executing device.

Figure 13:
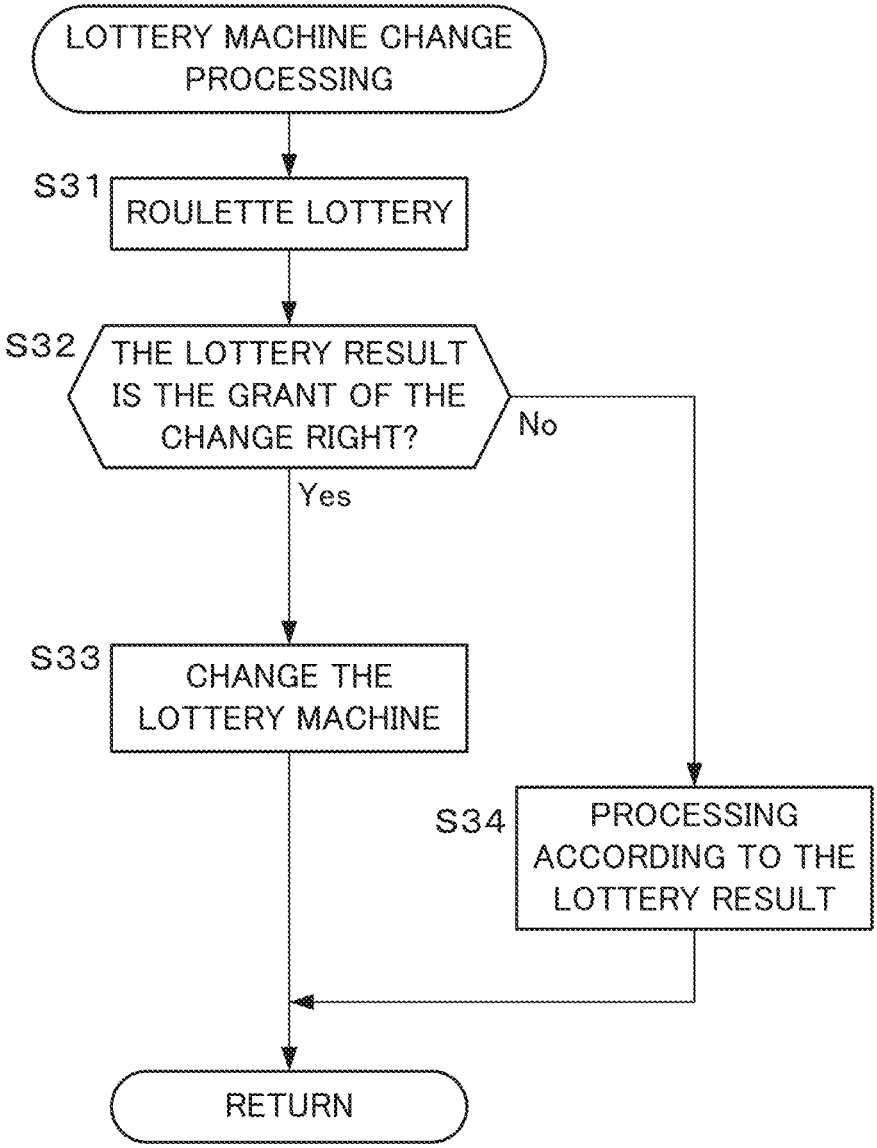
FIG. 13 is a flow chart illustrating a lottery machine change processing routine executed by a control unit of a game machine according to a second modification of the present invention.

In addition, in the slot lottery, the roulette lottery, or the like performed in the normal game, a change right of the lottery machine may be provided as a lottery option, and obtaining the change right may be set as the change condition. A second modification will be described below. Except the lottery machine change processing and the providing of the options of the change right in various lotteries executed in the normal game, the second modification is substantially identical to the above-described embodiment. Therefore, a description thereof will be omitted. FIG. 13 is a flow chart illustrating a lottery machine change processing routine executed by a control unit 40 of a game machine 1 according to a second modification of the present invention. First, the control unit 40 executes a roulette lottery of the normal game (step S31). As an example, the roulette lottery performed in the normal game will be described. The roulette lottery is executed when the ball B drops into the predetermined hole of the gate GT illustrated in the game screen GS of FIG. 4. Also, the roulette lottery may be executed in case that a predetermined game condition is satisfied, for example, when a predetermined enemy character EC is defeated. In the roulette lottery, the options such as a medal payment and receipt of items are set, but at least one of the options is set to a lottery machine change right as a change option.

The control unit 40 executes the roulette lottery, and determines whether the lottery result is the grant of the change right (step S32). When the roulette lottery result is the grant of the change right, the control unit 40 allows the player to change the lottery machine (step S33) and quits the processing. As for the change right that the player obtains, after the roulette lottery, the common display device 4 may be configured to notify the change of the lottery machine of other players and display the selection of the lottery machine. Also, in the execution of the chance game, the game machine may be configured to ask whether the player having the change right will change a lottery machine. Also, the obtained change right may be stored in the play data 45, and the player may use the change right at any timing. On the other hand, if the lottery result in step S22 is an option other than the change right, the control unit 40 executes processing according to the lottery result (step S34) and quits the processing.

In the above-described processing, when the option of the change right of the lottery machine is selected in any lottery game executed in the game machine 1 (step S32), the winning player is allowed to change the lottery machine (step S33). Since the roulette lottery performed in the normal game is executed more frequently than the chance game, the player can obtain the change right of the lottery machine of the chance game easily. Even when the lottery machine is changed into the lottery machine preferred by the player himself, there is a possibility that other players will change the lottery machine until the chance game is played. Therefore, competition with other players is generated, and suspense is generated in the game. The player is motivated to play the chance game during the setting of the preferred lottery machine, and thus the interest of the game can be increased. In the second modification, the processing of step S31 executed by the game control portion 42 of the control unit 40 serves as an option lottery device and the processing of step S33 executed by the lottery machine managing portion 43 serves as a lottery mechanism changing device.

Figure 14:
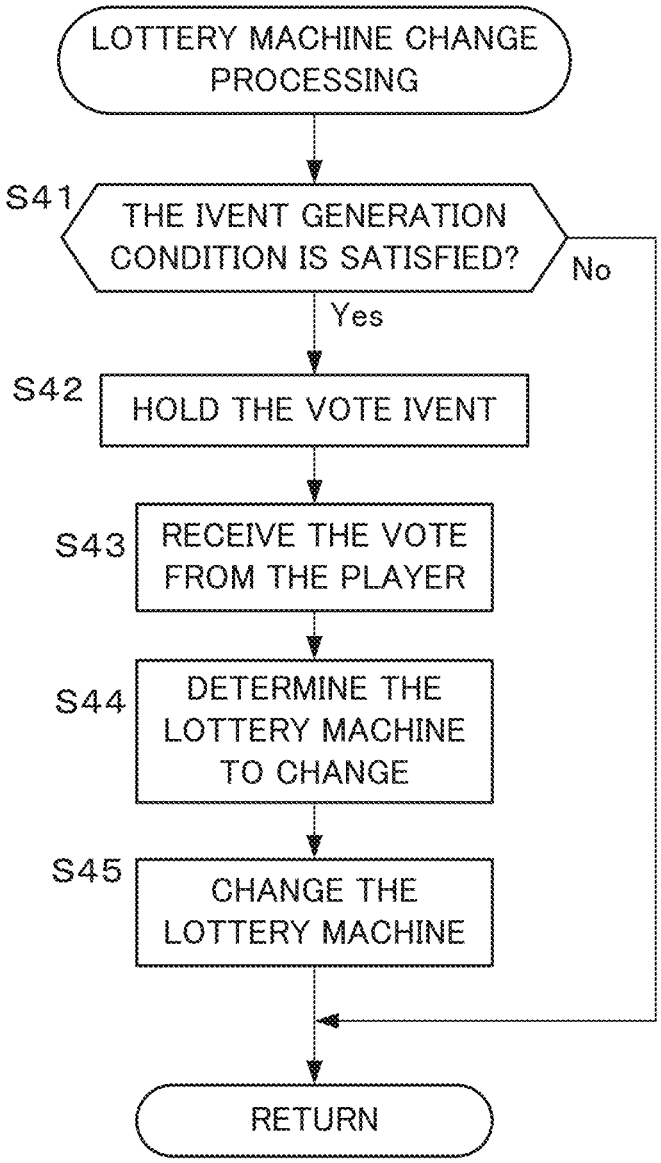
FIG. 14 is a flow chart illustrating a lottery machine change processing routine executed by the control unit of the game machine according to the third modification of the present invention.

Also, the change of the lottery machine may be determined by the vote in which all of the players playing in the game machine 1 can participate. A vote event is held, and a change-target lottery machine and a change-desired lottery machine are determined by a majority vote of the players. A third modification will be described below. Except the lottery machine change processing and the vote event, the third modification is substantially identical to the above-described embodiment. Therefore, a description thereof will be omitted. FIG. 14 is a flow chart illustrating a lottery machine change processing routine executed by the control unit 40 of the game machine 1 according to the third modification of the present invention. First, the control unit 40 determines whether an event generation condition as a vote condition for holding a vote event is satisfied (step S41). As the event generation condition, for example, the case where the chance game in the game machine 1 is challenged and the number of failures in the acquisition of the jackpot reaches 10 times is set. The jackpot can be obtained by winning the third lottery. However, in addition to the losing in the third lottery, the losing in the first or second lottery is also counted as the number of failures.

In case that the event generation condition is satisfied, the control unit 40 holds the vote event (step S42). In the vote event, the notification of the vote event is displayed on the monitor 13 of each station unit 2, and a plurality of types of combinations of a change-target lottery machine and after-change lottery machines is presented. At least one of the lottery machines used in the respective lotteries is designated as the change-target lottery machine. The control unit 40 receives the vote from the player (step S43). The control unit 40 receives the vote during a predetermined period, ends the vote after lapse of a predetermined period, and presents the vote result (step S44). The control unit 40 changes the setting to the lottery machine of the combination having the largest number of votes (step S45), and quits the processing. For example, when the combination "the third lottery machine is set to the lottery machine 51*d*" obtains the largest number of votes, the third lottery machine is changed into the lottery machine 51*d*. All of the players playing in the game machine 1 can participate in the vote event, and the combination having the largest number of votes is set as the lottery machine. A sense of unity is formed among the players playing in the game machine 1, and thus the interest of the game can be increased.

In the above-described processing, the event generation condition serves as the change condition, and when the vote event is generated (step S42), the lottery machine is changed into the combination of lottery machines having the largest number of votes (step S45). The processing of steps S41 to S44 executed by the game control portion 42 of the control unit 40 serves as a vote executing device, and the processing of step S45 serves as a lottery mechanism changing device. Incidentally, the lottery machine determined by the vote event is not limited to the lottery machine having the largest number of votes, but may be changed into, for example, the lottery machine having the smallest number of votes. The lottery machine may also be change into a lottery machine having the predetermined number of votes. Competition is generated among the players, and the interest of the vote event can be increased.

In the above-described aspect, three lotteries by the lottery machines have been executed as the chance game, but the present invention is not limited thereto. For example, one lottery may be executed as the chance game. The lottery machines used in one lottery may be changed into the aspect including the above-described modification. An appropriate modification may be made therein. The number of times of votes by the lottery machines may be changed, and the lottery machine changeable when a plurality of times of votes is performed may be designated. For example, only the first lottery machine may be changed. Incidentally, in the above-described aspects, a plurality of aspects may overlap with each other. For example, the player having lost the chance game may change the lottery machine and the option of the change right may be selected in the roulette lottery of the normal game. Also, all of the plurality of lottery machines 51*a* to 51*c* may be changed and may be changed into any combination. The change-target lottery machine may be changed appropriately.

In the above-described aspects, the game machine 1 has been described as a stand-alone type, but the present invention is not limited thereto. A game system may be configured such that a plurality of game machines 1 is connected to each other through a network, a common chance game is executed in the respective game machines 1 and the change of the lottery machine is shared between the respective game machines 1. One of the plurality of game machines 1 connected to each other may be set as a master, and the master may be configured to execute the processing related to the change of the lottery machine. The other game machines 1 may be set as slaves, and the change determined by the master may be set in the respective slaves. Also, the plurality of game machines 1 and a server device may be connected to each other through a network and the server device may be configured to execute the processing related to the setting or the change of the lottery machine. Accordingly, each game machine can execute the chance game using the common lottery machine. Also, the lottery machine change timing can be synchronized, and thus a sense of unity can be shared. For example, by holding a nationwide event in the game machines provided in nationwide stores, the interest of the game can be increased.

In the above-described embodiment, the lottery machine has been described as an electronic lottery mechanism including the control unit 40, but the present invention is not limited thereto. For example, the lottery machine may be a physical lottery mechanism. A variety of physical lottery mechanisms such as a slot device, a roulette device, a pinball device, and a pachinko device may be provided in the game machine and the player may select a desired lottery machine to be used in the lottery. The lottery machines have been described as lottery mechanisms of different games, but the present invention is not limited thereto. For example, the same type of game lottery mechanism may be provided. Even in the case of the same type of lottery mechanisms, the setting of the lottery probability may be changed. For example, a lottery mechanism for the beginner or the advanced may be provided. Also, the lottery probability or the payout may be changed flexibly.

A lottery machine providing a low lottery probability and low payout may be intentionally provided, or a lottery machine providing a high lottery probability and high payout in a predetermined condition may be selected. The lottery probability may be presented to the player at the selection of each lottery machine, or may not be presented to the player.

What is claimed is:

1. A game machine comprising:

a plurality of station units, each of the station units including an operation device configured to receive an operation of a player; a center unit including a display device configured to display a plurality of lottery mechanisms, each lottery mechanism having a different lottery probability; and, a game controller connected to each of the station units and the center unit, the game controller configured to receive the operation from each of the operation devices and transmit game data to the display device, the game controller including:

a lottery mechanism changing device configured to change the current lottery mechanism displayed on the display device to another lottery mechanism according to an operation input from at least one operation device that satisfies a predetermined change condition; and a lottery executing device configured to execute a lottery game by the lottery mechanism selected among the plurality of lottery mechanisms based on the operation from each of the operation devices as the lottery game applied to the game data, wherein the lottery executing device maintains the game data of the lottery game by the another lottery mechanism displayed on the display device in the case that the current lottery mechanism changes into the another lottery mechanism, and executes the lottery of the another lottery mechanism based on the operation from the operation device of the station unit played by another player.

2. The game machine of claim 1, wherein as the lottery probability of each of the plurality of lottery mechanisms decreases, the payout thereof increases.

3. The game machine of claim 1, wherein the losing in the lottery of the lottery game is set as the change condition and the lottery mechanism changing device allows the lost player to change the selected lottery mechanism.

4. The game machine of claim 1, wherein the execution of the lottery of the lottery game is set as the change condition and the lottery mechanism changing device allows the player playing the lottery of the lottery game to change the selected lottery mechanism before the execution of the lottery.

5. The game machine of claim 1, comprising: an option lottery device which selects any one of a plurality of options, wherein at least one of the plurality of options is a change option which allows the player to change the selected lottery mechanism, the winning selection of the change option in the lottery by the option lottery device is set as the change condition and the lottery mechanism changing device allows the winning player to change the selected lottery mechanism.

6. The game machine of claim 1, the game machine further including: a vote executing device which determines a lottery mechanism to be changed among the plurality of lottery mechanisms based on a vote by at least one player through one of the plurality of operating device that satisfies a predetermined vote condition and the lottery mechanism changing device changes the selected lottery mechanism into another lottery mechanism based on the vote by the vote executing device.

7. The game machine of claim 6, wherein the accumulated number of times of losing by all the players in the lottery game reaches a predetermined number of times is set as the vote condition.

8. A game machine comprising:

a plurality of station units, each of the station units including an operation device configured to receive an operation of a player; a center unit including a display device configured to display a plurality of lottery mechanisms, each lottery mechanism having a different lottery probability and configured to operate in a predetermined order; and a game controller connected to each of the station units and the center unit, the game controller configured to receive the operations from each of the operation devices and transmit game data to the display device; the game controller including:

a lottery mechanism changing device configured to change at least one lottery mechanism within the predetermined order according to an operation input from at least one operation device that satisfies a predetermined change condition; and a lottery executing device configured to execute a plurality of lottery games by some lottery devices selected among the plurality of lottery mechanisms based on the operation from each of the operation devices as a lottery game in a predetermined order applied through the game controller, wherein the lottery executing device maintains the game data of the combined lottery game by the plurality of changed lottery mechanisms in the case that the some lottery mechanisms change into the plurality of changed lottery mechanisms, and executes the combined lottery game of the plurality of changed lottery mechanisms based on the operation from the operation device of the station unit played by another player.

9. A game system comprising: a plurality of game machines and a server device in connection with the plurality of game machines through a network, each of the game machines comprising: a plurality of station units, each of the station units including an operation device configured to receive an operation of a player; a center unit including a display device configured to display a plurality of lottery mechanisms, each lottery mechanism having a different lottery probability; and a game controller connected to each of the station units and the center unit, the game controller configured to receive the operations from each of the operation devices and transmit game data to the display device, the game controller including:

a lottery mechanism changing device configured to change the current lottery mechanism displayed on the display to another lottery mechanism according to an operation input from at least one operation device that satisfies a predetermined change condition; and a lottery executing device configured to execute a lottery game by the lottery mechanism selected among the plurality of lottery mechanisms based on the operation from each of the operation devices as the lottery game applied to the game data, wherein the lottery executing device maintains the game data of the lottery game by the another lottery mechanism displayed on the display device in the case that the current lottery mechanism changes into the another lottery mechanism, and executes the lottery game of the another lottery mechanism based on the operation from the operation device of the station unit played by another player.

10. A game control method executed in a game machine which includes a plurality of station units, each of the station units including an operation device configured to receive an operation of a player; a center unit including a display device configured to display a plurality of lottery mechanisms, each lottery mechanism having a different lottery probability; and a game controller connected to each of the station units and the center unit, the game controller configured to receive the operations from each of the operation devices and transmit game data to the display device, the game control method comprising:

receiving, by the game controller, an operation input from at least one operation device; transmitting, through the game controller, the input from the at least one operation device to the center unit;

determining, through the game controller, if the operation input from the at least one operation device that satisfies a predetermined change condition;

changing, through the game controller, the current lottery mechanism displayed on the display device to another lottery mechanism according to an operation input from the operation device;

executing, through the game controller, a lottery game by the lottery mechanism selected among the plurality of lottery mechanisms based on the operation from each of the operation devices as the lottery game;

maintaining, through the game controller, the game data of the lottery game by the another lottery mechanism displayed on the display device in the case that the current lottery mechanism changes into the another lottery mechanism;

applying, through the plurality of station units, the lottery game including the changed lottery probability to the lottery game; and altering, through the game controller, the game data transmitted to another player as a result of the lottery game.

* * * * *